United States Patent [19]

James, III

[11] 3,989,402

[45] Nov. 2, 1976

[54] PAVING MACHINE WITH THICKNESS AND LEVELING CONTROL

[75] Inventor: W. Thomas James, III, Youngstown, Ohio

[73] Assignee: The Renner Company, Youngstown, Ohio

[22] Filed: Feb. 6, 1975

[21] Appl. No.: 547,548

Related U.S. Application Data

[63] Continuation-in-part of Ser. No. 391,882, Aug. 27, 1973, abandoned.

[52] U.S. Cl. ..... 404/110; 404/84

[51] Int. Cl.[2] ..... E01C 19/18

[58] Field of Search ..... 404/110, 84, 83, 101, 404/108

[56] References Cited

UNITED STATES PATENTS

| | | | |
|---|---|---|---|
| 3,029,714 | 4/1962 | Creswell | 404/110 |
| 3,158,945 | 12/1964 | Curlett | 404/84 X |
| 3,213,769 | 10/1965 | Smith | 404/110 |
| 3,228,310 | 1/1966 | Cartwright | 404/110 |
| 3,236,163 | 2/1966 | Ackerman | 404/84 |
| 3,247,771 | 4/1966 | Hanson | 404/84 |
| 3,264,958 | 8/1966 | Babb | 404/84 |
| 3,292,511 | 12/1966 | Cheney | 404/84 |
| 3,482,494 | 12/1969 | Jennings | 404/110 |
| 3,877,830 | 4/1975 | James | 404/110 |

*Primary Examiner*—Nile C. Byers, Jr.
*Attorney, Agent, or Firm*—Webster B. Harpman

[57] ABSTRACT

A paving machine of the towed type having an undercarriage and a hopper adjustably positioned thereon with a screed adjustably secured to the hopper is provided with sensors engaging the supporting surface on which the undercarriage travels and means responsive to the actuation of the sensors for adjusting the hopper and screed relative thereto.

6 Claims, 6 Drawing Figures

PAVING MACHINE WITH THICKNESS AND LEVELING CONTROL

This is a continuation-in-part of my application Ser. No. 391,882, filed Aug. 27, 1973 now abandoned.

BACKGROUND OF THE INVENTION

1. Field of the Invention

This invention relates to towed paving machines which position, level and partially compact bituminous paving materials and provide automatic regulation of the level and thickness of the material being laid.

2. Description of the Prior Art

The prior art paving machines of the towed type may be seen in U.S. Pat. Nos. 3,482,494 and 3,304,101 wherein manual adjustments are provided for varying the position of the screed and/or hopper of the machine to achieve a desired thickness and level of the material being laid.

In U.S. Pat. No. 3,285,148 an automatic grade control system is illustrated in operative relation to a bituminous paver in which the screed is positioned on the ends of a pair of trailing arms and means is provided for moving the trailing arms and therefore the screed to maintain grade control.

This invention incorporates the advantages of a relatively inexpensive towed paving machine with the automatic grade control heretofore found only in the complicated, expensive, self-propelled pavers.

SUMMARY OF THE INVENTION

A paving machine with thickness and leveling control incorporates an undercarriage and an adjustably positioned hopper thereon with means therebetween enabling the position of the hopper to be varied. A screed carried by the hopper is adjustably positioned with respect thereto and sensors engaging the surface over which the undercarriage travels actuate mechanisms varying the position of the hopper and the screed relative to the undercarriage so as to maintain thickness and level control of the material being laid and at the same time provide for manual adjustment and variation of the position of the hopper and the screed relative to each other and relative to the supporting undercarriage.

DESCRIPTION OF THE PREFERRED EMBODIMENT

Figure 1:
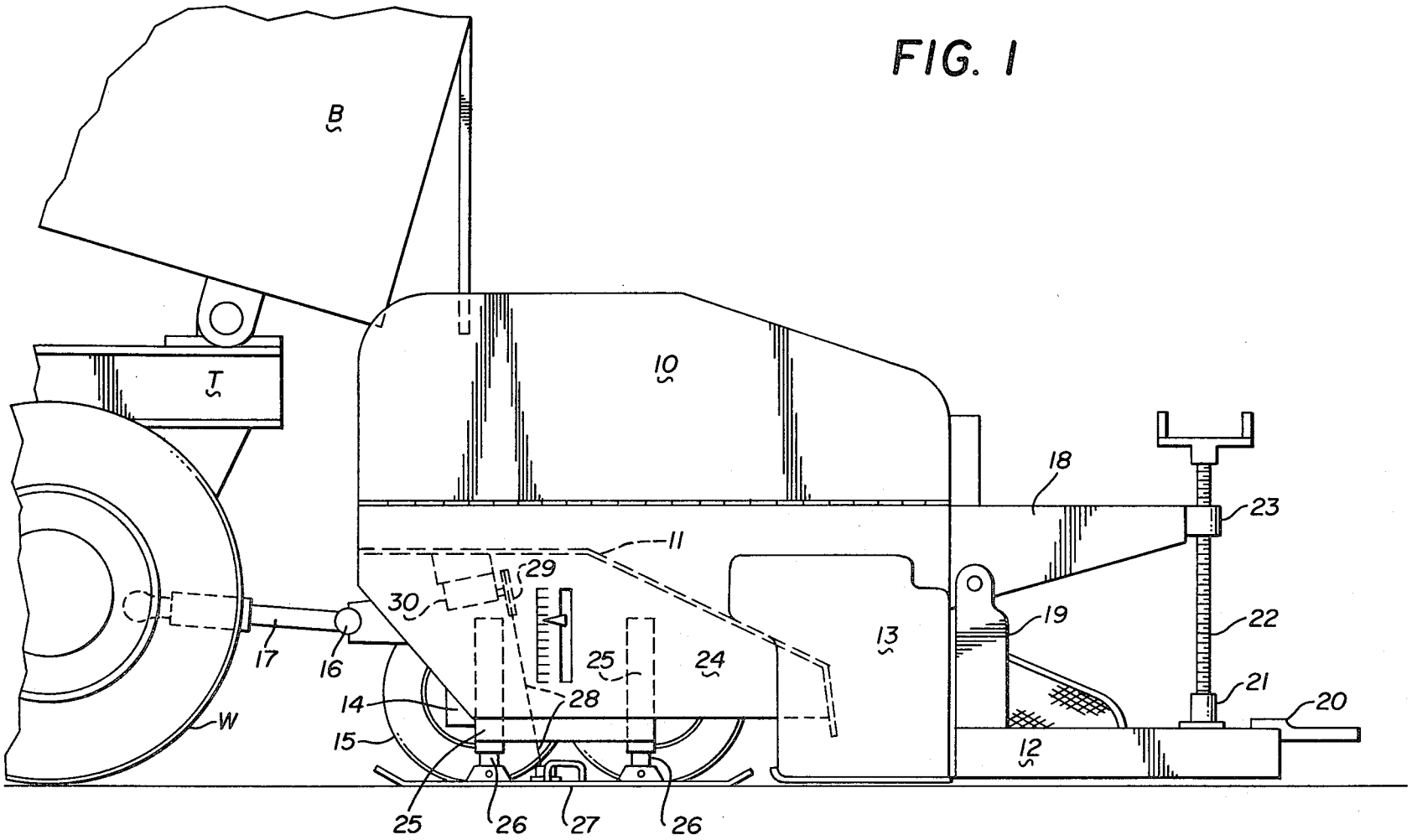
FIG. 1 is a side elevation of the towed paving machine with thickness and leveling controls.

In the form of the invention chosen for illustration and description herein the paving machine with thickness and leveling control subject to automatic actuation may be seen in its entirety in FIG. 1 of the drawings and by referring thereto it will be noted that a hopper 10 having a bottom 11 therein tapers toward a transverse opening in front of the forward edge of a sreed 12, the opening being defined by side plates 13. The hopper 10 is titlably supported on an undercarriage 14 which is provided with a plurality of ground engaging wheels 15, forward extensions 16 of the undercarriage 14 carry forwardly extending arms 17 which are movable in horizontal and vertical planes so that means on their forward free ends can be engaged in the wheels W of a truck T and the paver towed thereby.

A dump body B on the truck T delivers paving material to the hopper 10 as will be understood by those skilled in the art.

The hopper 10 is provided with a pair of spaced, rearwardly extending support arms 18 and the screed 12 is adjustably attached thereto. The forward edge of the screed 12 is carried on vertical arms 19 which are pivoted at their upper ends to the support arms 18 adjacent the hopper 10. The rearmost portion of the screed is provided with a step platform 20 and inwardly thereof with sockets 21 in which screw jacks 22 are engaged with the upper portions of the screw jacks 22 extending through threaded sockets 23 on the outer ends of the support arms 18.

The hopper 10 has depending side sections 24 and a pair of tubular guides 25 are positioned thereon and locate a pair of vertically movable rods 26, the lower ends of which are movably attached to skis 27. A flexible cable 28 is attached to each of the skis 27 and extends substantially vertically from its point of attachment to a reel 29 on a sensor 30.

Figure 2:
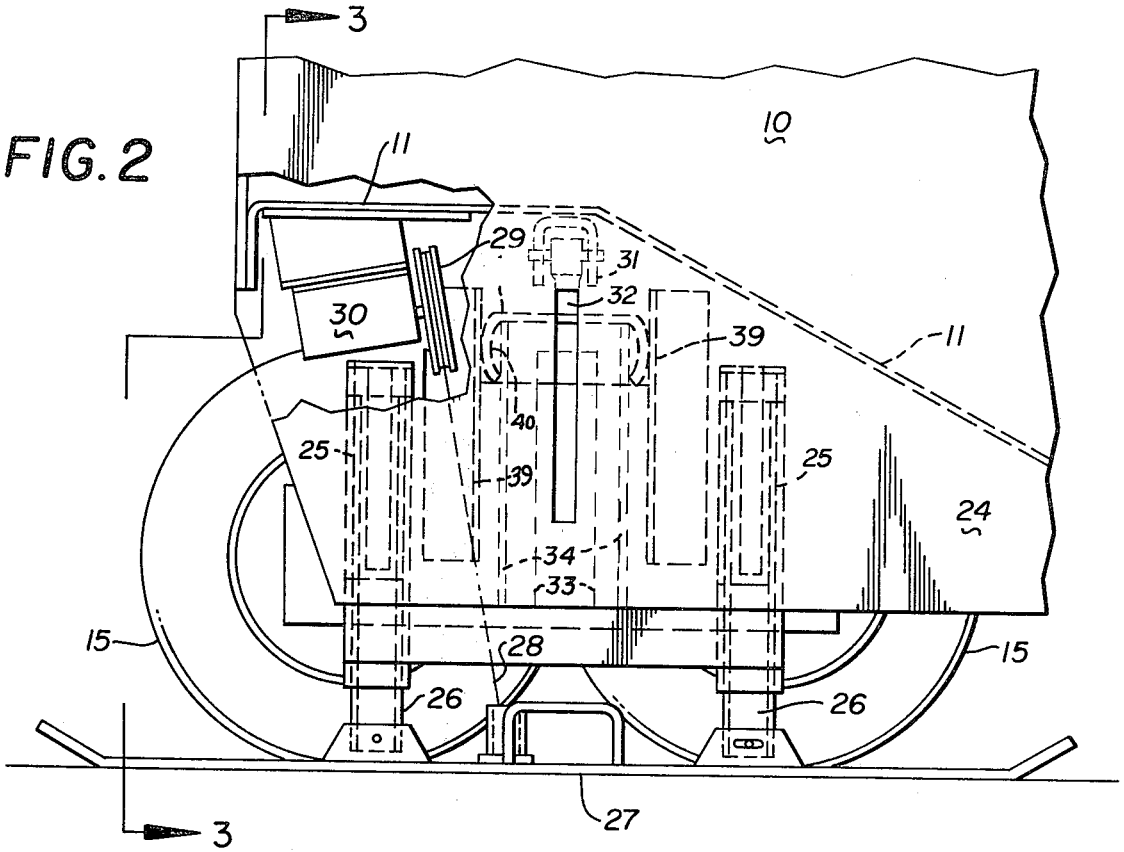
FIG. 2 is a enlarged detail of the machine seen in FIG. 1 with parts broken away.
Figure 3:
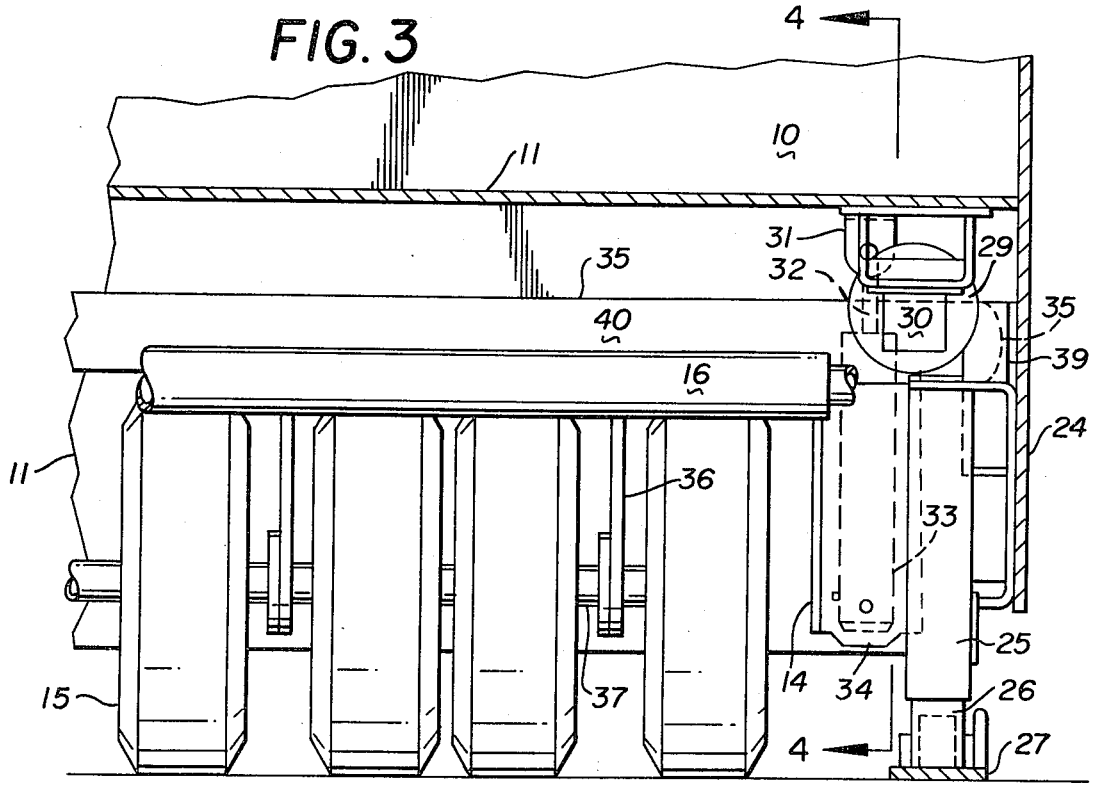
FIG. 3 is a vertical section on line 3—3 of FIG. 2.
Figure 4:
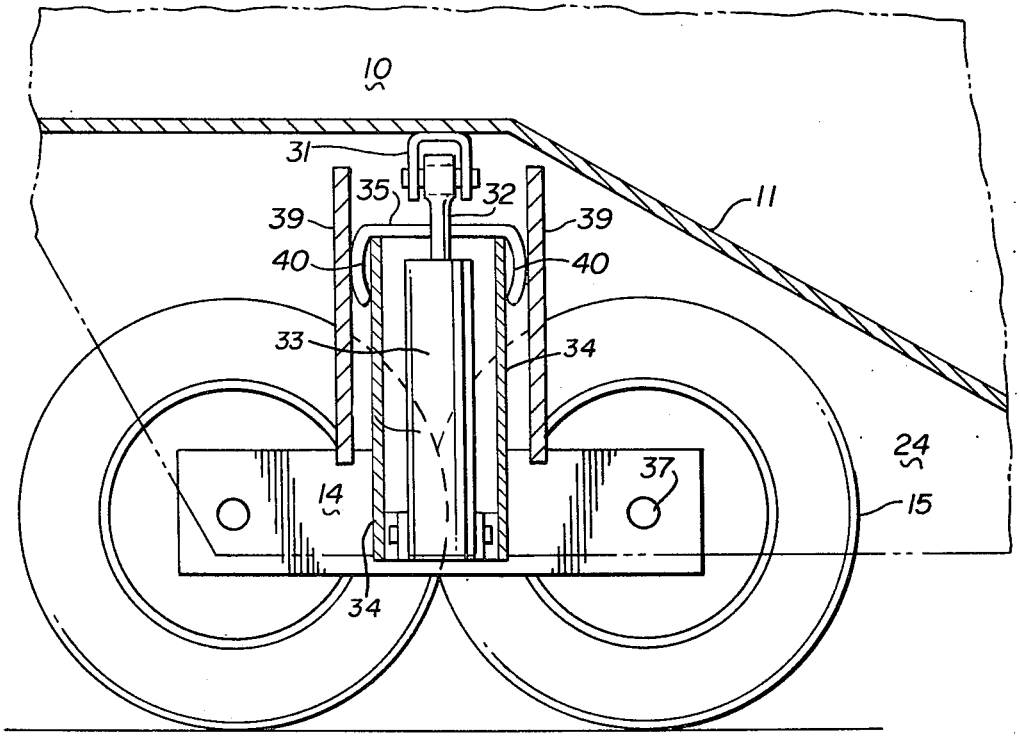
FIG. 4 is a vertical section on line 4—4 of FIG. 3.

It will thus be seen that when the truck T moves forwardly, to the left as seen in FIG. 1 of the drawings, the towed paver will move along with it and paving material deposited in the hopper 10 will be discharged through the opening in the rear portion thereof and leveled and partially compacted by the screed 12 passing thereover. The irregularities in the supporting surface traveled by the undercarriage 14 and its wheels 15 will be sensed by the skis 27, one of which is located at each side of the hopper 10, the movement of the skis 27 relative to the hopper 10 actuates the sensors 30 and the hydraulic piston and cylinders positioned between the undercarriage 14 and the hopper 10 and supporting the same may be actuated by valves in the hydraulic lines communicating with the piston and cylinder assemblies, the valves being subject to the control of the sensors 30 all as hereinafter described in connection with FIGS. 2, 3, and 4 of the drawings.

By referring thereto it will be seen that the bottom 11 of the hopper 10 is provided with brackets 31 which are movably attached to the upper ends of piston rods 32 of piston and cylinder assemblies 33. The lower ends of the piston and cylinder assemblies 33 are attached to downwardly extending frame members 34 which are attached to a horizontal beam 35. Axle supports 36 extend from the beam 35 and journel a pair of axles 37 in tandem arrangement on which a plurality of ground engaging wheels 15 are rotatably positioned. Spaced guides 39 on the ends 24 of the hopper 10 position and permit curved movement of vertical side sections 40 of the transverse beam 35 and it will thus be seen that actuation of the hydraulic piston and cylinder assemblies 33 will raise either or both ends of the hopper 10 relative to the beam 35 which is part of the undercarriage 14 heretofore referred to. The beam 35 movably engages guides 39 so as to permit vertical movement and tilting of the hopper from front to back.

It will further be seen that at such time as the wheels 15 move into a portion of the supporting surface either higher or lower than the portion just traversed, the skis 27 will also move so as to actuate the sensors 30 which actuate control valves in the hydraulic lines supplying the piston and cylinder assemblies 33 as hereinafter described. The resultant action is to change position of the hopper 10 and the screed 12 attached thereto so that a level course of the paving material being laid is maintained by changing the attack angle of the screed.

Figure 6:
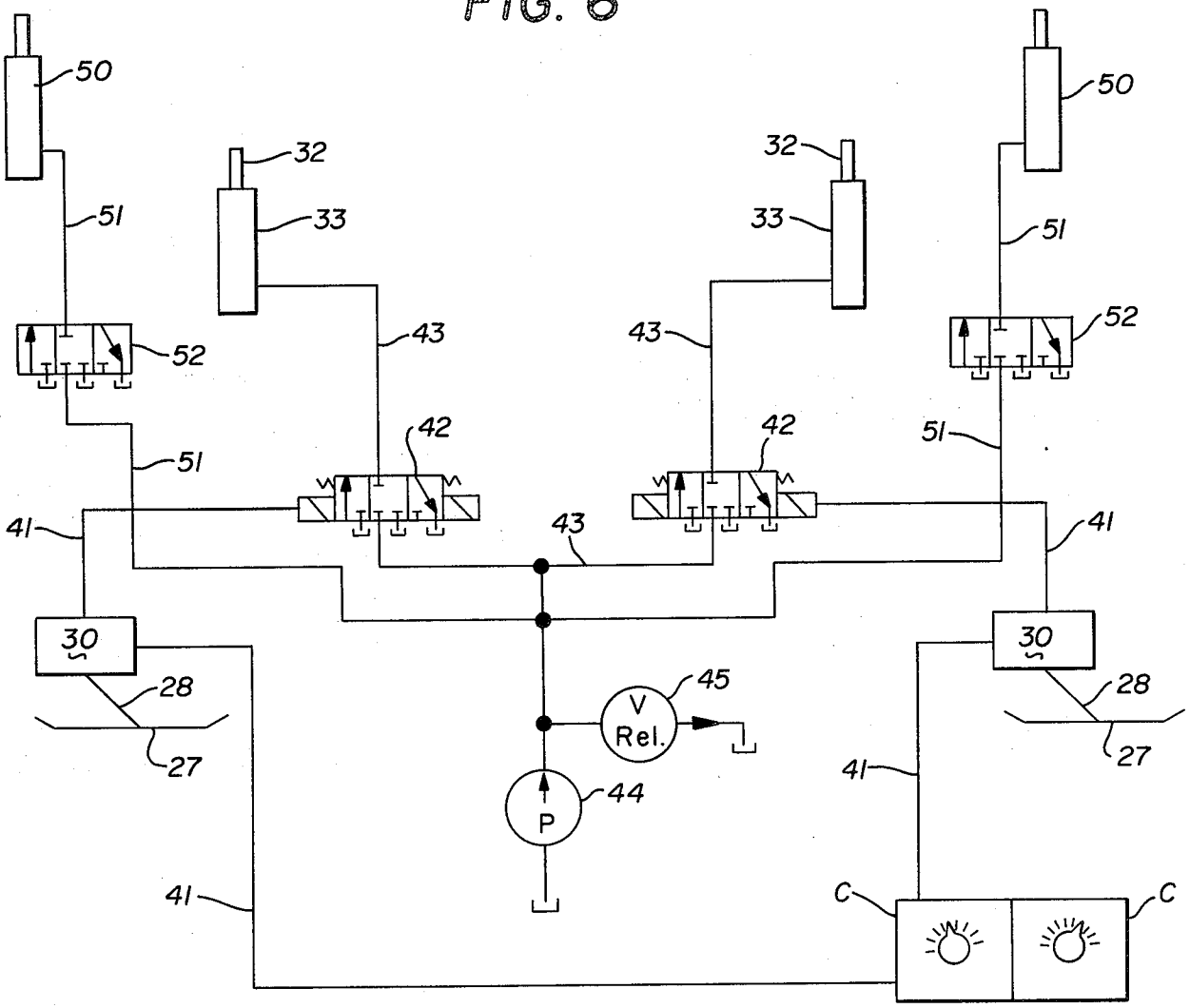
FIG. 6 is a diagrammatic view of the automatic leveling means.

By referring now to FIG. 6 of the drawings, the automatic leveling mechanism incorporated in the towed paver to translate the signals from the sensors 30 to actuation of the hydraulic piston and cylinder assemblies 33 may be seen. By referring thereto the skis 27 are diagrammatically connected with the sensors 30 which are potentiometers in electric circuits 41 which are connected with a pair of solenoid actuated hydraulic valves 42, each of which controls a fluid pressure line 43 in communication with one of the piston and cylinder assemblies 33 and with a pump 44. A relief valve 45 communicates with the pressure system and the solenoid valves 42 are so arranged that they will connect the piston and cylinder assemblies 33 with the fluid pressure line 43 so as to move the piston rods 32 outwardly thereof as in elevating the respective ends of the hopper 10 of the paver. Alternately the solenoid valve 42 will disconnect the piston and cylinder assemblies 33 from the fluid pressure supply lines communicating with the pump 44 and place the piston and cylinder assemblies 33 in communication with the liquid reservoir in the system.

Those skilled in the art will observe that there is an electric power source such as a battery in the control system to supply energy for the actuation of the solenoid valves. The sensors 30 which are potentiometers are arranged to vary the flow of current to the solenoid valves 42 dependent upon their actuation by the movement of the skis 27.

The piston and cylinder assemblies 33 can be manually or automatically actuated as in initially setting the hopper 10 and the screed 12 to a desired position to produce a paving mat of the desired thickness and/or slope and upon such setting being made the sensor 30 are set to a zero position so that the resulting actuation by the skis 27 will increase or decrease the current flow controlled by the sensors 30 and thereby actuate the hydraulic valves 42 as desired to raise and/or lower the hopper 10 of the paver responsive to irregularities in the supporting surface over which the paver travels. Such movement of the hopper 10 causes the paver to tilt transversely with the screed acting as a fulcrum and it thus changes the angle of attack of the screed relative to the paving material being laid.

It will thus be seen that the automatic control of the thickness and grade and level of the paving material being laid by the paver is quickly accomplished by moving the hopper 10 and screed 12 of the paver relative to the undercarriage 14 which supports the same on the surface being paved. Modification of the structure hereinbefore disclosed may be made to facilitate the adjustment of the paver to accommodate various work conditions and one such modification may be seen by referring to FIG. 5 of the drawings.

Figure 5:
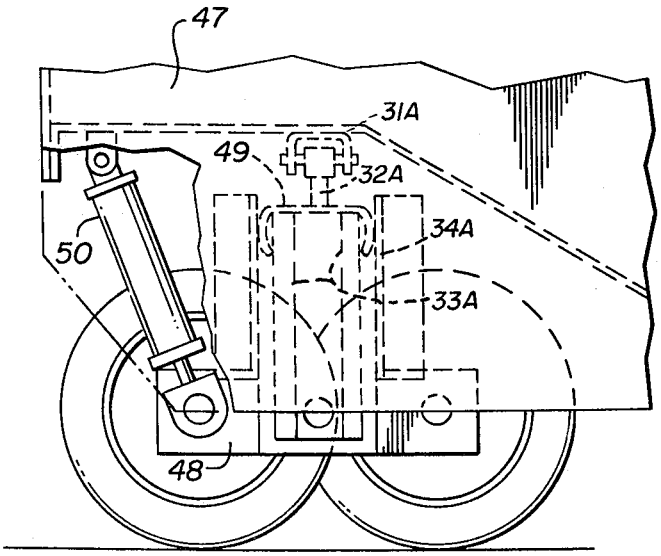
FIG. 5 is a side elevation of a portion of a paver showing a modification in the adjustment means.

In FIG. 5 a paver including a hopper 47 having an undercarriage 48 in supporting relation thereto by way of hydraulic piston and cylinder assemblies 49 all in the manner as in the form of the invention hereinbefore described in connection with FIGS. 1–4 of the drawings is provided with a pair of secondary hydraulic piston and cylinder assemblies 50 pivotally engaged on the foremost portions of the undercarriage 48 and the foremost corners of the hopper 47.

In FIG. 6 of the drawings, the secondary piston and cylinder assemblies 50 will be seen to be connected by hydraulic fluid lines 51 so as to communicate with the pump 44 thereof with control valves 52 positioned therein and arranged to be actuated so as to direct fluid under pressure into the piston and cylinder assemblies 50 or either one of them whereby the front portion of the hopper 10 can be titled upwardly relative to the undercarriage 48 and the screed (not shown) attached thereto also tilted so as to change the angle of attack of the screed with respect to paving material being engaged thereby.

It will occur to those skilled in the art that it is desirable to employ a hydraulic fluid supply system which is pressurized at all times the paver is in operation so that the various hydraulic piston and cylinder assemblies may be operated as desired and the operation of the main piston and cylinder assemblies 33 subject to the control of the skis 27 and the sensors 30 may be continuous. The automatic control system on the paver can be placed in condition for operation by moving the paver onto a roadway to be paved and attaching it to a truck so that it can be towed thereby and supplied with paving material therefrom. The position of the hopper 10 and the screed 12 is then adjusted to the desired thickness and/or slope desired in the paving material to be laid and the screed is adjusted to set the desired angle of attack. The sensors 30 are set to a zero position and the paver is then operated by being towed forwardly by the truck and will operate to maintain the desired grade. Any change in the grade in relation to the paver causes the sensors 30 to operate the hydraulic piston and cylinder assemblies 33 and desirably compensate therefore.

It will thus be seen that the towed paver disclosed herein is capable of operating automatically to maintain the desired grade and/or slope angle in a mat of paving material being laid thereby by the novel adjustment of the hopper and screed of the paver relative to the ground engaging undercarriage supporting the same.

Although but two embodiments of the invention have been illustrated and described, it will be apparent to those skilled in the art that various changes and modifications may be made therein without departing from the spirit of the invention.

Having thus described my invention what I claim is:

1. The combination of a towed paving machine and grade sensing and control means therefor, the machine comprising; an undercarriage, a plurality of support wheels beneath said undercarriage, an elongated transverse beam in said undercarriage, said transverse beam being attached to said support wheels and essentially U-Shaped in cross-section having a base and a pair of legs which are curved outwardly of said base, a hopper located above said undercarriage and beam, pairs of spaced vertical guides located on opposite ends of said hopper to define guide channels therebetween into which the ends of said transverse beam are received with said outwardly curved legs tangentially and slidably contacting said vertical guides so that said transverse beam is slidably received in said guide channel in a manner such that said beam can rotate about the longitudinal axis thereof, a plurality of frame members attached to said transverse beam, and extendible devices connecting said transverse beam and said hopper, said extendible devices each having one end thereof pivotally connected to a bracket on said hopper and the other end thereof connected to one of said frame members, a screed, pivots attaching said screed to said hopper adjacent a material depositing opening in said hopper, adjustable means on said hopper engaging said screed in spaced relation to said pivots for changing the angle of attack of said screed relative to said hopper and a power source mounted on said hopper for said extendible devices, said transverse beam being slidably and rotatably received in said guide channels enabling said hopper and screed to be moved vertically and tilted from front to back relative to said undercarriage as said machine is towed over a surface to be paved thereby; said sensing and control means being on said hopper and comprising skis movably supported on said hopper and engaging said surface to be paved, means on said hopper connected to said skis for emitting a signal, secondary means controlling said power source with respect to said extendible devices and the hopper and screed to change the angle of attack of the hopper and screed responsive to movement of the skis due to deviation in the grade of said surface to be paved.

2. The combination of claim 1 wherein said means for emitting a signal comprise potentiometers and energized electrical circuits, said extendible devices being electrically operated and said secondary means being in said electrical circuits and in connection with said electrically operated extendible devices.

3. The combination of claim 1 further characterized by said extendible devices comprising a pair of piston and cylinder assemblies adjustably attaching said hopper to said undercarriage and spaced with respect to one another so as to tilt said hopper from side to side.

4. The combination of claim 1 wherein said hopper has a foremost section and further including a secondary extendible device connecting said foremost section to said undercarriage for tilting said foremost section relative to said undercarriage with said screed as a fulcrum point to thereby change the angle of said screed with respect to the paving material being engaged by said screed.

5. The combination of claim 1 further characterized by said grade sensing means being located on the sides of said hopper between the front and the rear thereof.

6. The combination of claim 1 further characterized by said grade sensing and control means being adjustable with respect to each of said extendible devices so as to enable a slope angle from one side to the other of said hopper and screed to be set and maintained continuously on a desired grade line.

* * * * *